US005209216A

United States Patent [19]

Mogi

[11] Patent Number: 5,209,216

[45] Date of Patent: May 11, 1993

[54] CHAIN CUTTER

[75] Inventor: Katsumi Mogi, Omiya, Japan

[73] Assignee: Mitsubishi Metal Corporation, Tokyo, Japan

[21] Appl. No.: 850,222

[22] Filed: Mar. 12, 1992

Related U.S. Application Data

[63] Continuation of Ser. No. 586,942, Sep. 24, 1990, abandoned.

[30] Foreign Application Priority Data

| | | | |
|---|---|---|---|
| Sep. 22, 1989 | [JP] | Japan | 1-247674 |
| Nov. 17, 1989 | [JP] | Japan | 1-298835 |
| Dec. 12, 1989 | [JP] | Japan | 1-322237 |

[51] Int. Cl.[5] ..... B28D 1/08

[52] U.S. Cl. ..... 125/21; 83/831

[58] Field of Search ..... 83/788, 830, 831, 832, 83/833, 834; 125/21; 30/166.3; 51/136

[56] References Cited

U.S. PATENT DOCUMENTS

| | | | |
|---|---|---|---|
| 614,003 | 11/1898 | Johnson . | |
| 1,116,881 | 11/1914 | Giampietro | 83/830 |
| 1,178,362 | 4/1916 | Wall . | |
| 1,229,597 | 6/1917 | Farrer | 83/830 |
| 1,520,422 | 12/1924 | Lind . | |
| 1,598,953 | 9/1926 | Daw . | |
| 1,671,295 | 5/1928 | Kirby . | |
| 1,779,983 | 10/1930 | Bens . | |
| 2,049,172 | 7/1936 | Osgood | 125/21 |
| 2,348,612 | 5/1944 | Deacon . | |
| 2,481,835 | 9/1949 | Gannon . | |
| 2,488,343 | 11/1949 | Standal . | |
| 2,869,534 | 1/1959 | Stihl | 125/21 |
| 3,228,437 | 1/1986 | Wezel . | |
| 3,747,652 | 7/1973 | Meadows | 30/166.3 X |
| 3,910,147 | 10/1975 | Heyerdahl | 83/830 |
| 3,999,294 | 12/1976 | Shoben | 30/166.3 |
| 4,242,796 | 1/1981 | Barausch et al. | 30/166.3 |
| 4,309,931 | 1/1982 | Alexander | 83/832 |
| 4,414,876 | 11/1983 | Lolqerot | 83/831 X |
| 4,464,964 | 8/1984 | Alexander . | |
| 4,562,761 | 11/1986 | Alexander | 83/830 |
| 4,787,363 | 11/1988 | Kubo | 125/21 |
| 4,971,022 | 11/1990 | Scott et al. | 125/21 |

FOREIGN PATENT DOCUMENTS

| | | |
|---|---|---|
| 2758380 | 7/1979 | Fed. Rep. of Germany . |
| 3416712 | 11/1985 | Fed. Rep. of Germany . |
| 532069 | 1/1922 | France . |
| 595055 | 9/1925 | France . |

*Primary Examiner*—Frank T. Yost
*Assistant Examiner*—Rinaldi Rada
*Attorney, Agent, or Firm*—Scully, Scott, Murphy & Presser

[57] ABSTRACT

A chain cutter comprises an endless chain body including a plurality of plate-like flaps connected to each other to provide angular movement in a common plane; each of the flaps has an end face on a inner peripheral side of said chain body, and at least a part of said flaps has a cutting device at the end face.

16 Claims, 14 Drawing Sheets

1
6
8
8A
10
30
38
40

1
10
204
206
30
38
40
200
202
8
C
D

CHAIN CUTTER

This is a continuation of copending application Ser. No. 586,942 filed on Sep. 24, 1990, now abandoned.

BACKGROUND OF THE INVENTION

1. Field of the Invention

The present invention relates to a chain cutter for cutting large workpieces such as stone, wood or the like.

2. Background Art

Conventionally, cutting of rocks, for example, is carried out using an abrasive cutting blade, a band saw, a wire saw or the like.

The abrasive cutting blade is such that a plurality of abrasive bits, in which diamond abrasive grains are fixed to an outer peripheral surface of a disc-like metal base formed by roll processing, by means of metal bond or the like, are fixedly mounted at equal intervals. At present, the maximum diameter of cutting blade manufactured is 3.5 m and whose metal base has its thickness of 10 mm. For the cutting blade of this dimension or size, the maximum thickness of object which can be cut is of the order of 1.5 m, and the cutting allowance is of the order of 15 mm.

On the other hand, a band saw is such that a strip-like metal thin plate, which is wide and which is of the order of 1 mm to 6 mm in thickness, is welded in an endless manner, and the abrasive bits are fixedly mounted to one side edge of the endless thin plate. The endless thin plate extends between and is wound about a pair of rotating bodies whose axes are arranged in parallel relation to each other. The said bodies are rotated at high speed, thereby cutting stone or the like by an edge of any one of parallel sections between the rotor bodies.

The wire saw is endless such that a plurality of cylindrical diamond abrasive bits are fixedly mounted to a metal wire whose thickness is of the order of a few millimeters to 10 mm, coaxially and at equal intervals. The wire saw is directly wound about the workpiece, and is driven at high speed with a constant tension applied by a drive apparatus, thereby cutting the workpiece.

However, any of the above-described cutting means have the following problems.

First, the cutting blade has the following problem. That is, if the cutting blade is made large in diameter, the thickness of the metal base must inevitably be increased in view of the strength requirement, and this increases the thickness of the abrasive bits. For this reason, the cutting allowance increases so that the yield of the workpiece is reduced. Further, twist or torsion occurs at the nose because of an increase in the cutting resistance. Thus, cutting accuracy is reduced.

Further, cutting blade has also other problems. That is, since manufacturing of a metal base exceeding 3.5 m in diameter is extremely difficult, there is a limit in thickness of the workpiece to be cut, as described previously. Moreover, such large cutting blade is extremely inconvenient in handling such as transportation or the like, noises due to vibration at cutting are also high.

On the other hand, since, in the band saw, the metal base is small in thickness even if the metal base is long in entire length, the cutting allowance is of the order of 4 mm to 8 mm and is relatively small. Thus, the yield is superior. However, the band saw extends between and is wound around a pair of large-size rotating bodies, and the said bodies are rotated axially to practice cutting. Accordingly, the cutting apparatus increases in size, and a large work space is required.

Furthermore, the band saw has the following problem. That is, bending stress is repeatedly applied to bent sections formed by winding of the band saw around the rotating bodies, metal fatigue is apt to be accumulated in the metal base. Thus, the metal base is broken relatively prematurely, and the service life of the metal base is short.

In the wire saw, since the abrasive bits used are large in diameter, the cutting allowance is large as compared with the cutting blade or the band saw. Further, the wire saw is circular in cross-section, and has, by itself, no strength restricting the cutting direction. Accordingly, the wire saw is inferior in flatness and surface roughness of the cut surface as compared with other cutting means. Furthermore, in the wire saw, since large bending stress is applied to both end portions of each of the abrasive bits during cutting, service life for reaching bit and wire breakage is short. Breakage of the wire is dangerous because the ends of the wire jumps up and down like a whip.

SUMMARY OF THE INVENTION

An object of the invention is to provide a cutting tool which provides improved qualities of cutting large objects. A chain cutter according to the invention is characterized in that a plurality of flaps each in the form of a plane or flat plate are connected to each other for angular movement in a common plane to form an endless chain body, and that a plurality of cutting device is provided on at least parts of the flaps at a location at the inner end face of the chain body.

The chain cutter is operated by winding the chain body about an outer periphery of a workpiece to be cut, and driving said chain body in the longitudinal direction under tension to sever the workpiece.

According to the chain cutter, since the flaps each in the form of a plain plate are connected to each other for angular movement in the same plane to form the endless chain body, it is possible to obtain a sufficient tension-resisting force by the relatively thin flaps. The thickness of each of the cutting device can be reduced. Thus, the cutting allowance of the workpiece can be reduced to improve the yield.

Further, since the flaps are connected to each other for angular movement, stress fatigue does not occur in the curved section of the chain cutter, and it is possible to use the chain cutter with a correspondingly greater tension force applied. Accordingly, the depth of each cut can be set to a value larger than the conventional cutting means. Thus, it is possible to enhance the cutting efficiency.

Moreover, mere increase or decrease in the number of connected flaps enable the length of the chain to be freely increased or decreased. Thus, the workpiece to be cut is not restricted in size or dimension. The individual flaps are small and identical in configuration with each other. Accordingly, an attempt can be made to reduce the manufacturing cost by mass-production. Thus, it is possible to reduce the manufacturing cost of the entire chain cutter.

Further, since the advancing direction of the cutting device is steadily guided by the flaps, each in the form of a plane plate, the flatness and surface roughness of the cut surface are superior, and no one-sided wear occurs in the cutting device. Thus, the chain cutter is a high performance cutting device.

Furthermore, since the flaps are used under such a condition that they extend between and are wound about the disc-like sprockets or the like, there is produced an advantage that the working space for the apparatus can be reduced.

Moreover, since the chain cutter is in the form of a chain, and is relatively light in weight, handling such as transportation or the like is easy, and vibration occurring due to cutting is attenuated at the connecting sections between the flaps. Thus, it is possible to reduce the noises as compared with other cutting tools.

DETAILED DESCRIPTION OF THE PREFERRED EMBODIMENTS

Various embodiments of the invention will be described next with reference to the drawings.

Figure 1:
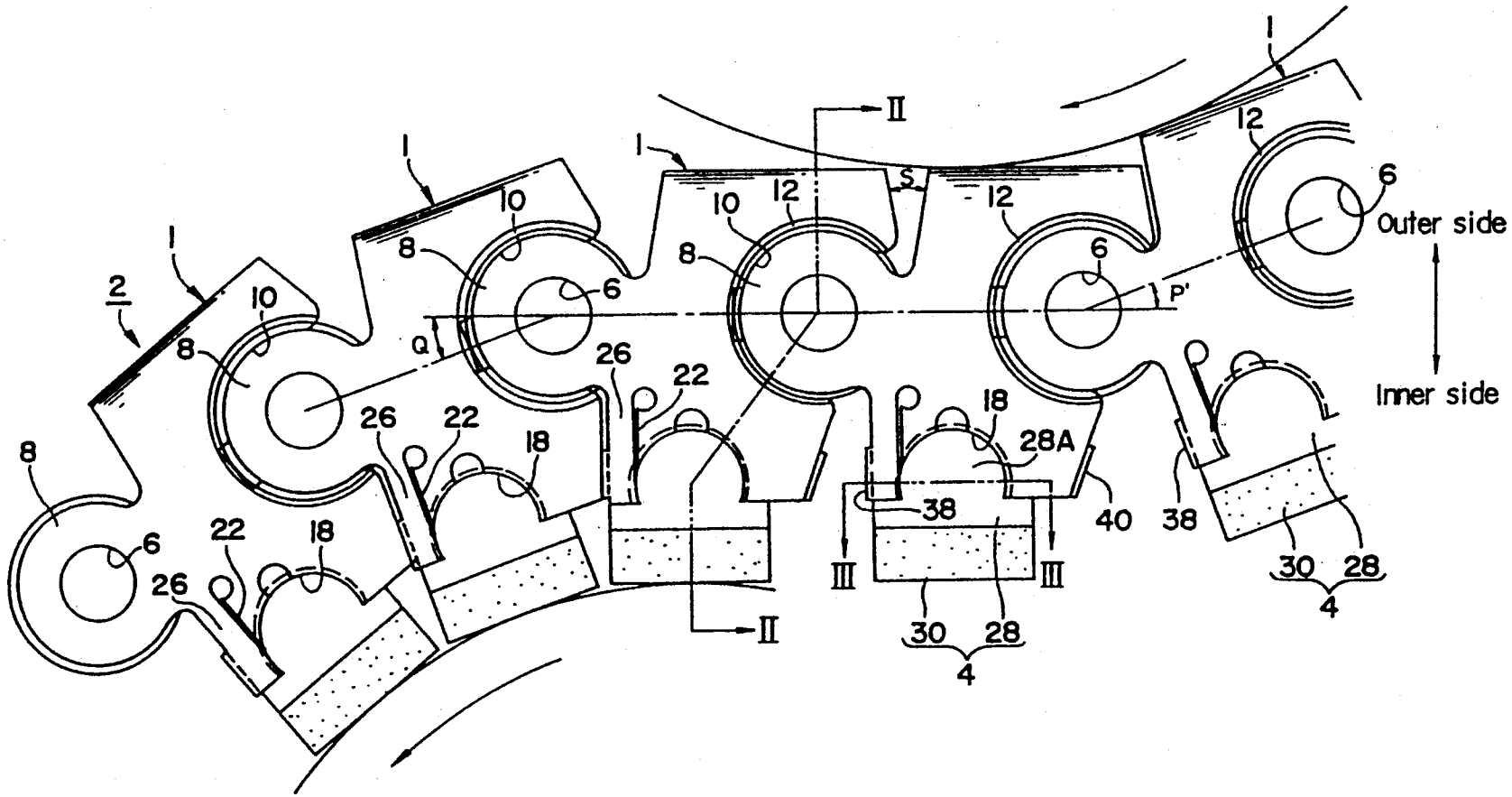
FIG. 1 is a partial front view of a chain cutter according to a first embodiment of the invention.
Figure 2:
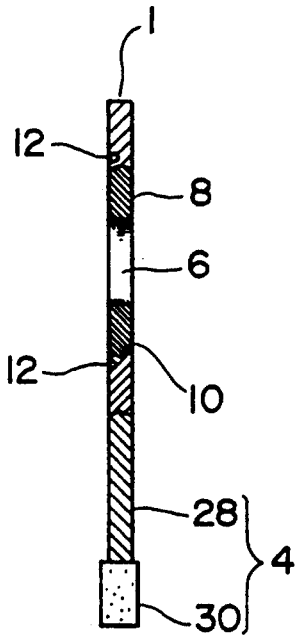
FIGS. 2 and 3 are cross-sectional views taken along the line II—II in FIG. 1 and a cross-sectional view taken along the line III—III in FIG. 1, respectively.
Figure 3:
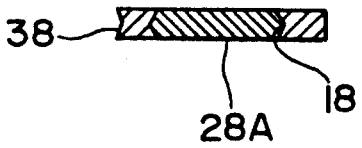

FIG. 1 shows a chain cutter according to a first embodiment of the invention. The chain cutter comprises an endless chain body 2 in which a plurality of flaps 1 each in the form of a plane or flat plate are connected to each other for angular movement along a common plane, and a plurality of abrasive bit segments 4 (hereinafter referred to as cutting device 4) fixedly mounted to inner peripheral ends of the respective flaps 1.

Each of the flaps 1 is in the form of a rectangular plate having its constant thickness, and is made of metal such as SK steel, stainless steel, SKD steel, SUP steel, SNCM steel or the like. It is desirable that the hardness of the flap 1 is brought to HRc 30 to 65 by hardening treatment or the like. If the hardness of the flap 1 is less than HRc 30, it is impossible to obtain sufficient strength, while, if the hardness is higher than HRc 65, forming of the flap 1 becomes difficult.

Figure 4:
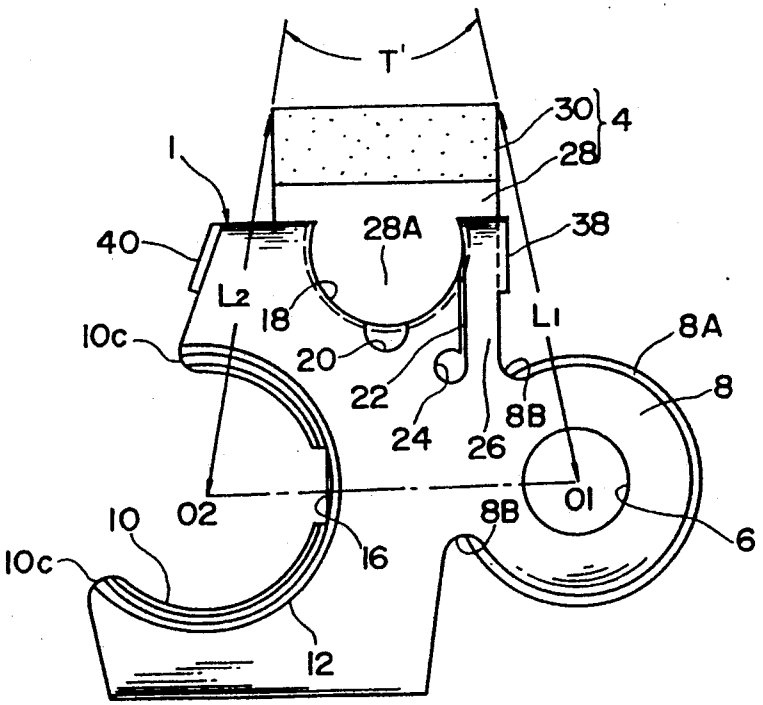

A connecting structure between each pair of adjacent flaps 1 will be described next. As shown in FIG. 4, each of the flaps 1 is formed with a connecting projection 8 in the form of a disc, at a side face of the flap 1 which faces the rotational direction. A connecting cut-out 10 is formed at an opposite side face of the flap 1 in the rear of the rotational direction, and has its dimension substantially the same as the connecting projection 8.

Figure 5:
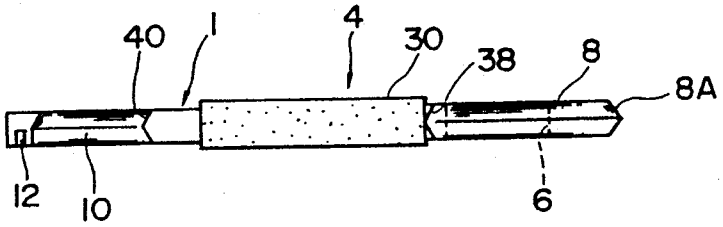
FIGS. 4 through 6 are a front view, a top view and a left side view, respectively, showing one of a plurality of flaps of the chain cutter illustrated in FIGS. 1 through 3.

The connecting projection 8 has its outer peripheral surface 8A which, as shown in FIG. 5, is formed into a V-shaped convex configuration in cross-section along its entire periphery. It is preferable that the V-shaped configuration has a cross-sectional angle of the order of 60° to 170°. If the cross-sectional angle is less than 60°, it is difficult to form the outer peripheral surface 8A, and the connecting strength thereof is reduced, while, if the cross-sectional angle is larger than 170°, there is a possibility that the connection comes off in the thickness direction of the flap 1.

Figure 6:
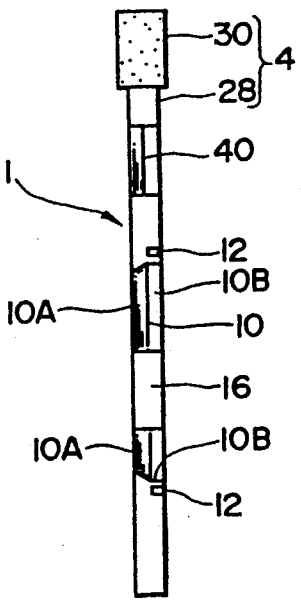

On the other hand, the inner peripheral surface of the connecting cut-out 10 has its portion extending from the thickness center of the flap 1 to the back surface only, as shown in FIG. 6, which is brought to a tapered surface 1OA complementary in cross-sectional configuration with the connecting projection 8. On the other hand, a portion of the inner peripheral surface 10B of the connecting cut-out 10, which extends from the aforesaid thickness center to the front surface of the flap, is brought perpendicular to the front face. The cut-out 10 has its diameter which is set slightly larger than the maximum diameter of the connecting projection 8.

Further, the flap 1 has its front side which is formed with a curved staking groove 12 at a location slightly spaced away from the connecting cut-out 10.

Figure 7:
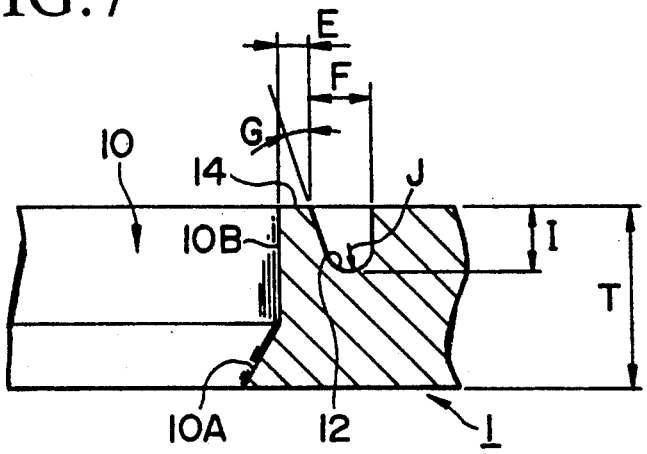
FIGS. 7 through 9 are enlarged cross-sectional views showing a method of connecting the flaps to each other.

As shown in FIG. 7, it is desirable that a quantity of spacing E from the vertical wall surface 10B to the staking groove 12 is of the order of 0.5 mm to T mm (the flap thick thickness), particularly, of the order of 0.5 mm to 3 mm. If the quantity of spacing E is equal to or larger than T mm, staking operation subsequently to be described will become difficult, while if the quantity of spacing E is less than 0.5 mm, the staking will become insufficient in strength.

The staking groove 12 has its opening width F of 1 mm to T mm, desirably, of 1 mm to 5 mm. If the opening width F is within this range, the staking operation will become easy in practicing, so that there is no problem in reduction of the strength at this portion.

The staking groove 12 has a portion of its inner wall surface adjacent the vertical peripheral wall 1OB, which is brought to a tapered surface along the entire length. It is desirable that an angle G defined by the tapered surface and the vertical line is 1O° to 45°. If the angle is out of this range, the staking operation will become difficult. This angle G is larger than an angle L (refer to FIG. 8) defined by the tapered surface 8A of the connecting projection 8 and the vertical line. If G is less than L, it is impossible to practice sufficient staking.

The staking groove 12 has its depth I which is 30% to 60% of the flap thickness T and, more desirably, 30% to 50% thereof. If the depth I is less than 30%, engagement of the connecting projection 8 due to the staking will become difficult, while, if the depth I is larger than 60%, the connecting strength will be reduced.

Figure 8:
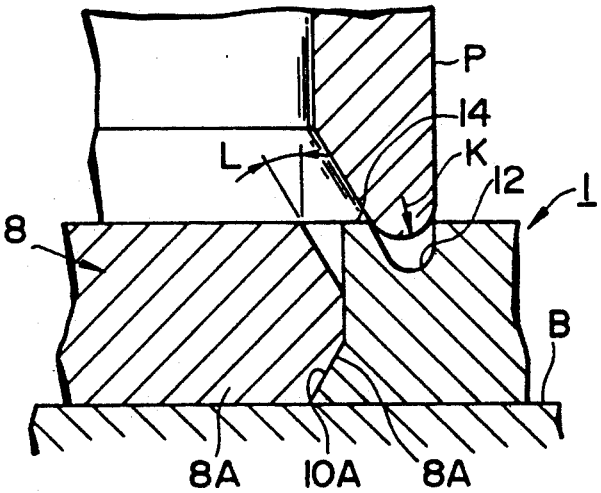

The reference character P in FIG. 8 denotes a punch which is used in staking operation and which is fixedly mounted to an upper mold of a press machine (not shown). The punch P has its lower end which is in the form of a curved configuration in cross-section fitted in the staking groove 12 along its entire length. An outer peripheral surface side of the punch P is brought to a vertical surface extending in parallel relation to the punch axis, while an inner peripheral surface side of the punch P is brought to a tapered surface. Further, the lower end of the punch P has its longitudinal cross-sectional surface which is curved. A radius of curvature K of the curved surface is larger than a radius of curvature J (refer to FIG. 7) of the inner bottom surface of the staking groove 12.

Figure 9:
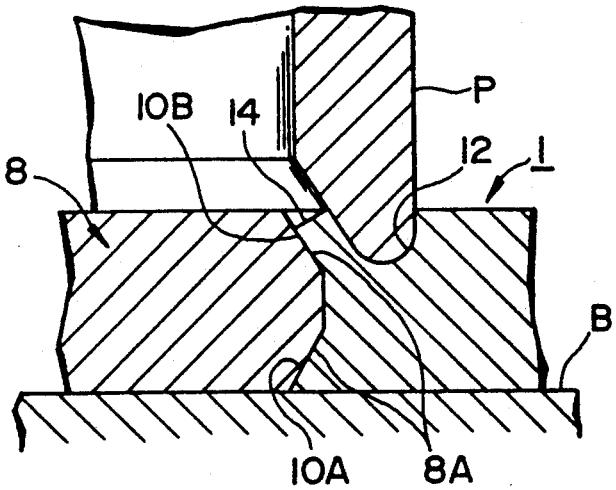

Connecting of the flap 1 is done as follows. First, as shown in FIG. 8, the flap 1 rests on a base B of the press machine with the staking groove 12 directed upwardly. The connecting projection 8 of another flap 1 is fitted in the connecting cut-out 10 from the side of the vertical peripheral wall 1OB, and the lower end of the punch P is abutted against the staking groove 12. Then, a pressure is applied to the punch P by the press machine. By doing so, as shown in FIG. 9, the punch P pushes and enlarges the staking groove 12. Thus, a projecting portion 14 is bent inwardly, so that the vertical peripheral surface 1OB is abutted against the tapered surface 8A without any gap.

Subsequently, when the punch P is moved upwardly, the projecting portion 14 returns slightly toward its original position under elasticity, so that an extremely small gap which enables a sliding movement between them is formed between the vertical peripheral surface 1OB and the tapered surface 8A. Thus, the connection is completed.

The connecting projection 8 has a pair of narrowed neck portions 8B, as shown in FIG. 4, which are formed respectively into curved configurations, in order to prevent stress concentration. Further, the connecting cut-out 10 has, at its opening, a pair of side portions 1OC each of which is chamfered into an curved configuration having its radius of curvature smaller than that of a corresponding one of the constricted neck portion 8B.

The flaps 1 are movable angularly through an angle P' toward the outer peripheral side, and through an angle Q toward the inner peripheral side as shown in FIG. 1, the angles being measured in the condition that the flaps 1 are arranged with the aforementioned centers aligned with each other on a straight line. These angles P' and Q are dependent upon the cutting apparatus, the workpiece and so o used in the chain cutter.

As shown in FIG. 4, a distance L1 from the center 01 of the connecting projection 8 to the edge of the abrasive bit 30 is set equal to a distance L2 from the center 02 of the connecting cut-out 10 to the opposite edge of the abrasive bit 30. The subtended angle T' between these segments is set to a value slightly larger than the aforesaid maximum inward bending angle Q, such that the abrasive bits 30 will not interfere with each other when the chain body 2 is bent inwardly.

A life judging mechanism for the flap 1 will next be described. A shallow C-shaped life judging groove 16 is formed at a center of the inner peripheral edge of the connecting cut-out 10. A distance from the center 02 of the connecting cut-out 10 to the bottom surface of the life judging groove 16 is set to one slightly larger than the maximum radius of the connecting projection 8.

Figures 10, 11:
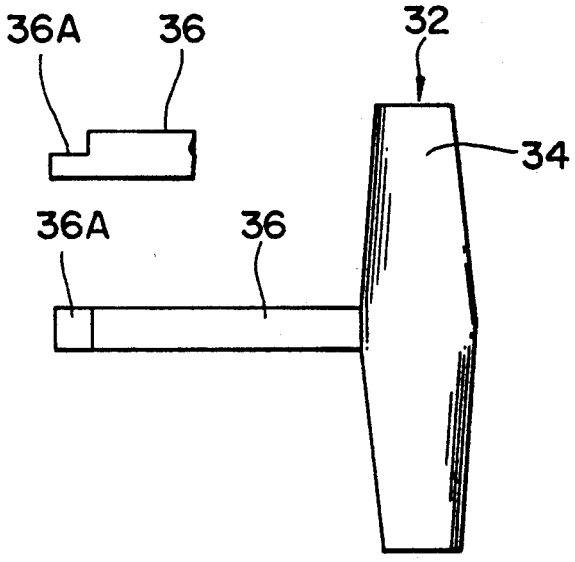
FIGS. 10 and 11 are a top view and a partial front view, respectively, showing a mounting and demounting jig for the flaps.

By doing so, as shown in FIG. 11, under the condition that the flaps are connected to each other, a slight gap is formed between the life judging groove 16 and the outer periphery of the connecting projection 8. If a quantity of the gap is measured with a thickness gage or the like, it is possible to judge a quantity of wear of the connecting projection 8 and the connecting cut-out 10. Thus, the quantity of wear will become a measure of service life. In this connection, the forming position of the life judging groove 16 is not limited to the center of the connecting cut-out 10, but may be any position along the circumference. In this connection, if the life judging groove 16 is formed in the center, the sensitivity with respect to the quantity of wear will be raised.

Figure 12:
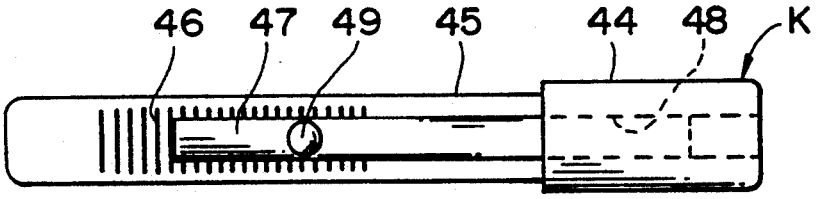
FIGS. 12 and 13 are a top view and a front view, respectively, showing a wear inspecting tool for the flaps.
Figure 13:
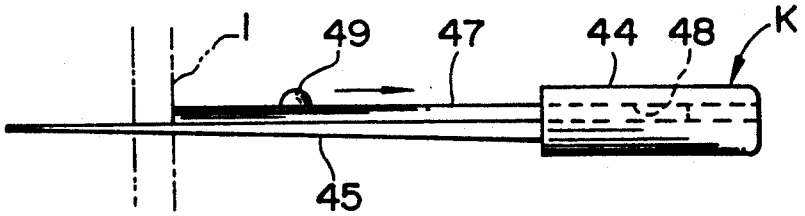

FIGS. 12 and 13 show a thickness gage K which is used in measurement of the quantity of wear. In these figures, the reference numeral 44 denotes a handle, while the reference numeral 45 designates a tapered portion in the form of an elongated thin plate fixedly mounted to one end of the handle. The tapered portion 45 has its thickness which is smaller, at its forward end, than the aforesaid quantity of gap G, and which increases gradually toward the side of the handle 44. The tapered portion 45 has its front surface on which graduations 46 are shown. An elongated plate-like slide bar 47 is arranged along the graduations 46. The slide bar 47 is held in a bore 48 formed in the handle 44. Furthermore, the slide bar 47 has its upper surface which is formed with a protrusion 49.

In order to inspect the quantity of wear at the connecting section, the tapered portion 45 of the thickness gage K is inserted perpendicularly through the life judging groove 16. By doing so, the slide bar 47 is abutted against the flap 1 so that the forward end of the slide bar 47 shows one of the graduations 46, which indicates the quantity of wear.

In connection with the above, the life judging groove 16 should not be limited to one having the illustrated configuration. The life judging groove 16 may be semi-circular or the like in configuration. Further, the life judging groove 16 may have its arrangement that a life judging groove having its semi-circular configuration or the like is formed also in the outer peripheral edge of the connecting projection 8, and a thickness gage having a rod-like or bar-like tapered section is used under the condition that both life judging grooves are in conformity with each other, to judge the wear quantity.

A fixation structure for the cutting device 4 will next be described. As shown in FIG. 4, each flap 1 has its outer end face which is formed with a semi-circular segment mounting recess 18, offset slightly, toward the rotational direction, from the center of the end face of the flap 1. The segment mounting recess 18 has its inner peripheral surface whose cross-section is formed into a V-shaped groove configuration along the entire length of the inner peripheral surface. The mounting recess 18 has its bottom which is formed with a small semi-circular jig inserting groove 20.

The mounting recess 18 is provided with a slit 22, starting from the inner periphery and heading towards the outer periphery of the chain cutter, and terminating at one end with a circular bore 24 for stress relieving. A longitudinal portion divided by the slit 22 is made into an elastic engaging piece 26. Deflection of the elastic engaging piece 26 forwardly, in the rotational direction, enables mounting and demounting of the cutting device 4.

On the other hand, the cutting device 4 is composed of a bit support 28 having its thickness the same as that of the flap 1 and made of metal, and a rectangular abrasive bit 30 fixedly mounted to the end face of the bit support 28. The abrasive bit 30 has its thickness which is set thicker than the bit support 28, to prevent the bit support 28 and the flap 1 coming into frictional contact with a cut surface of a workpiece.

The abrasive bit 30 is a metal-bonded abrasive layer containing diamond, CBN grains or the like and is fixedly mounted to the chip support 28 by means such as soldering, integral sintering, laser welding, electron beam welding or the like. In this connection, the grain or particle size, the degree of concentration and the thickness of the abrasive bits should be determined depending upon the use of the chain cutter.

The chip support 28 is integrally formed with a semi-disc projection 28A complementary in configuration with the mounting recess 18. The semi-disc projection 28A has its peripheral surface which is formed into a convex V-shaped configuration in cross-section. The projection 28A is capable of being fitted in the segment-mounting recess 18 when the slit 22 is opened, and the projection 28A is strongly held in the segment-mounting recess 18 when the elastic engaging piece 26 is returned to its original position.

In connection with the above, FIGS. 10 and 11 show the aforesaid mounting and demounting jig 32 which is in the form of a letter T having a handle 34 and a shaft 36. The shaft 36 has its forward end 36A which is formed into a semi-circle in cross-section identical in size with the jig inserting groove 20. The forward end 36A is inserted in the jig inserting groove 20, and the handle 34 is moved angularly through 90°, whereby the cutting device 4 is removed against the engaging force of the elastic engaging piece 26.

As shown in FIGS. 4 and 5, a side face of the flap 1 on the inner peripheral side is formed with an engaging groove 38 in the shape of a concave V-shaped cross-section, and the opposite end face of the flap 1 is in the shape of an engaging convex V-shaped cross-section projection 40. When the flaps 1 are bent inwardly through the maximum inward bending angle Q, the engaging groove 38 and the engaging projection 40 are connected firmly with each other to prevent distortion of the flap 1 in the thickness direction.

The connecting projection 8 of each of the flaps 1 is formed, at its center, with a circular throughbore 6. The throughbore 6 is set to such a diameter that the strength of the connecting projection 8 is not reduced, and a drive pin 66 formed at an outer periphery of a sprocket 62 (refer to FIG. 14) can easily go in and out of the throughbore 6 when the sprocket 62 is rotated. The throughbore 6 has an opening edge which is chamfered such that the drive pin 66 smoothly goes into the throughbore 6 o the front surface side of the flap 1.

In connection with the above, the arrangement may be such that the configuration of the throughbore 6 is altered to a rectangular bore, an elongated bore, an elliptical bore or the like extending longitudinally along the chain, to facilitate the drive pin 66 to go into the throughbore 6. Further, the throughbore 6 should not be limited to the location illustrated, but may be formed at any other location having no problem in view of strength of the flap 1.

A method of using an inner-peripheral-blade type chain cutter constructed as above will next be described.

Figure 14:
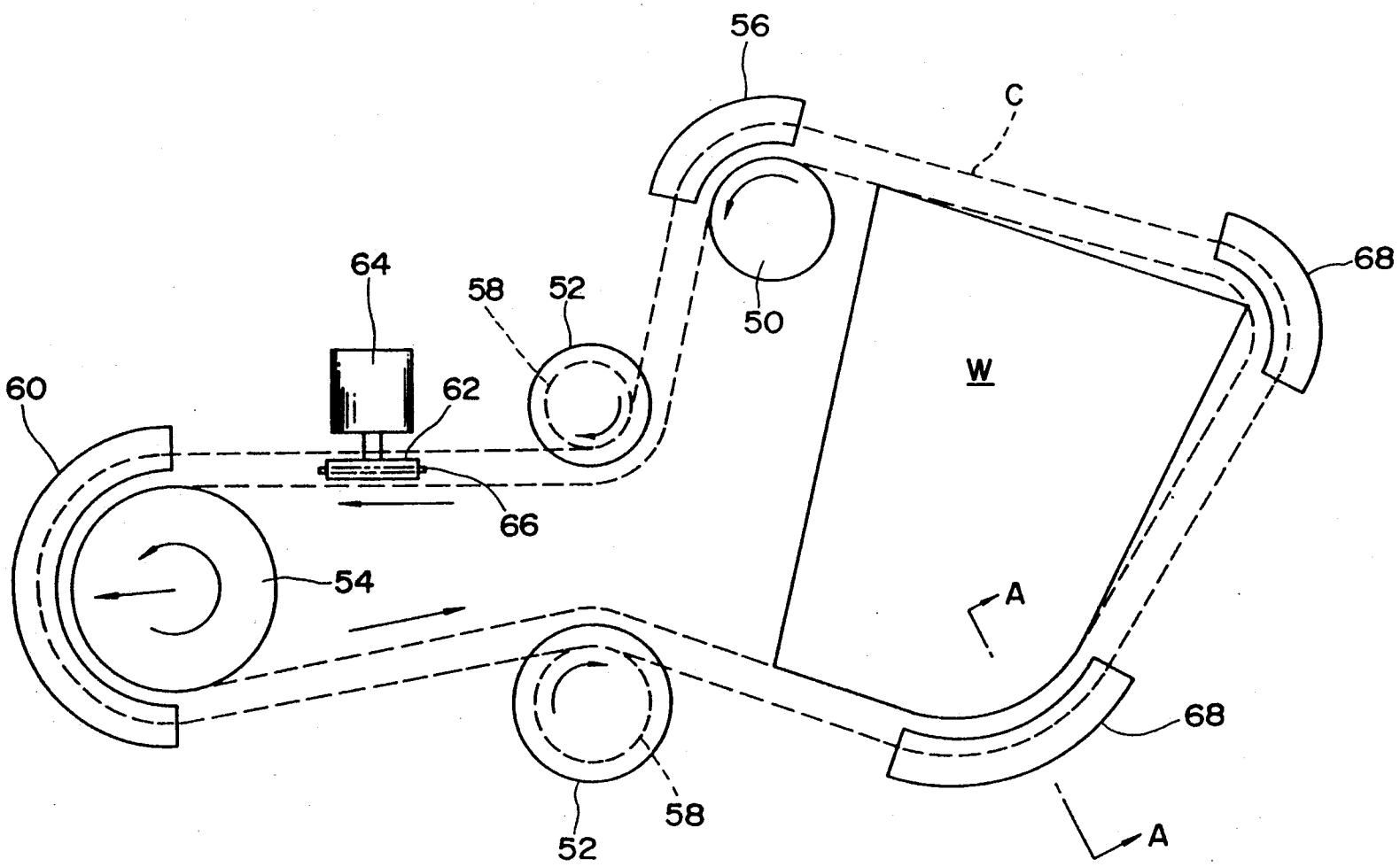
FIG. 14 is a top view of a cutting apparatus which uses the chain cutter.

FIG. 14 shows a condition that the workpiece W such as a structure or the like is cut horizontally. The inner-peripheral-blade type chain cutter C is arranged horizontally around the structural object W, and extends among and is wound horizontally about an inner-side support pulley 50, a pair of outer-side support pulleys 52 and a moving pulley 54, all located at the same height with each other. The suitable arrangement of the pulleys 50, 52 and 54 is determined depending upon conditions at work site. Thus, the arrangement of the pulleys 50, 52 and 54 should not be limited to the illustrated arrangement.

The inner-side support pulley 50 and the pair of outer-side support pulleys 52 are mounted to a base (not shown) which is fixedly mounted to the ground, and are rotatable horizontally. Further, the inner-side support pulley 50 is provided with a guide element 56 for restricting the position of the outer peripheral side of the chain cutter C, while each of the outer-side support pulleys 52 has its outer periphery which is formed with a slit 58. The chain cutter C has its half on the outer peripheral side, which is fitted in the slits 58.

The moving pulley 54 is mounted to a moving pedestal (not shown) which travels on rails or the like (not shown), for horizontal rotation. The moving pedestal is movable, with a constant force, in a direction coincident with the direction of the straight chain section. Moreover, the moving pulley 54 is provided with a guide element 60 which clamps the outer peripheral side of the chain C.

The drive sprocket 62 is vertically arranged on the straight section of the chain cutter C. The drive sprocket 62 has its outer peripheral surface which is abutted against the individual flaps 1. The drive sprocket 62 is adapted to be rotated by a drive motor 64. A plurality of pins 66 is fixedly mounted to the outer peripheral surface of the drive sprocket 62 at the same intervals as the drive throughbore 6. The arrangement is such that the pins 66 are successively fitted in the throughbores 6 while the drive sprocket 62 is rotated to drive the flaps 1 forward.

Figure 15:
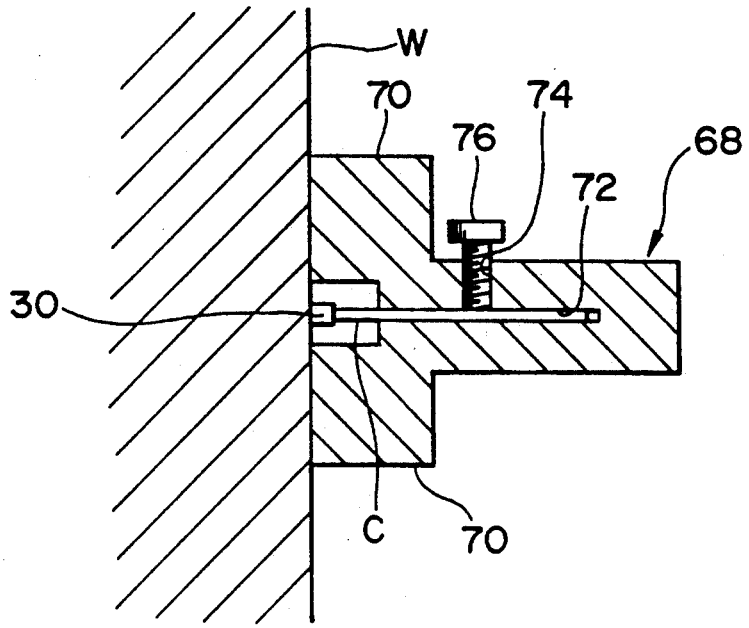
FIGS. 15 and 16 are longitudinal cross-sectional views, respectively, showing a wear inspecting jig for the above-described cutting apparatus.

The reference numerals 68 denote a pair of guide jigs for restricting the cutting position of the chain cutter C. Each of the guide jigs 68 is in the form of an arc in plan view, and has its cross-section which is formed into a T-shaped configuration with a wide flange 70 on the inner peripheral side, as shown in FIG. 15 (which is a cross-sectional view taken along the line A—A in FIG. 14). Further, the guide jig 68 has its inner peripheral side whose center is formed with a groove 72 along its entire length. The chain cutter C can be accommodated in the groove 72 with the abrasive bit 30 facing inwardly. The center of the inner peripheral said of the guide jig 68 is also formed with a bolt bore 74 which extends through the wall surface of the guide jig 68 and which reaches the groove 72. A bolt 76 is threaded into the bolt bore 74.

Cutting is made by the apparatus in the following manner. First, the chain cutter C is installed in the grooves 72 in the aforesaid respective guide jig 68. As shown in FIG. 15, the guide jigs 68 are arranged horizontally at the corner of the workpiece W to be cut. The flange 70 is fixedly mounted to the wall surface of the workpiece W, by means of, if the workpiece W is concrete or the like, a dryvit, a boring anchor, a chemical bonding or the like is suitable. Otherwise, bolt fixing or the like is also possible.

Subsequently, the moving pulley 54 is moved horizontally toward the direction of the arrow in FIG. 4. The drive motor 64 operates on the drive sprocket 62, while a tension force is applied to the chain cutter C, to cause the chain cutter C to travel in the direction shown by the arrows.

Figure 16:
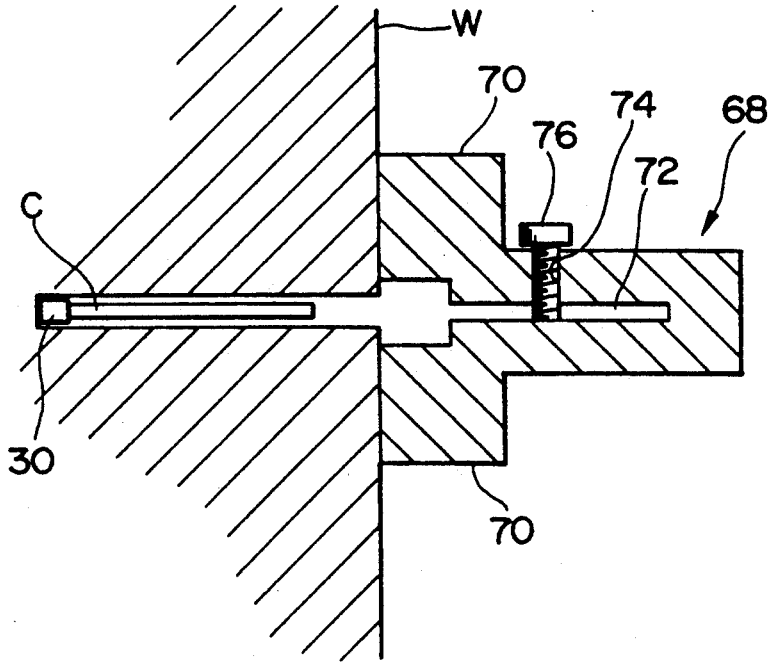

The chain cutter C starts cutting from the corner of the workpiece W, and advances into the interior of the workpiece W while moving gradually away from the guide jigs 68. In due course, as shown in FIG. 16, once the chain cutter C is completely withdrawn from the guide jig 68, the bolt 76 is tightened so that the groove 72 in the guide jig 68 will not collapse under the weight of the workpiece W, thereby preventing the closure of the groove formed in the workpiece.

By so moving the pulley 54 gradually, while inserting a thin spacer or the like into the groove as necessary the cutting is continued until the chain cutter C emerges from the opposite side of the workpiece W.

According to the chain cutter constructed as above, since the flaps 1 each in the form of a flat plate are connected to each other in the common plane to form the endless chain body 2, sufficient tension-resistant force can be produced by relatively thin flap 1, and the thickness of the cutting device 4 can also be reduced. Thus, the cutting cost can be lowered, making it possible to improve the yield.

Further, since the flaps 1 are connected to each other for angular movement, stress fatigue does not occur at the curved sections of the chain cutter C, so that it is possible to use the chain cutter C with a larger applied tension than that in conventional machines. Thus, it is possible to set a larger cutting bite than that achievable by the conventional cutting machines, leading to higher cutting efficiency.

Furthermore, in the chain cutter C, the connecting sections between adjacent flaps 1 wear with use, causing the endless chain cutter C to gradually lengthen so that the cutter C becomes unusable. Accordingly, the chain cutter C is not susceptible to sudden breakage during cutting, and its safety is high.

Moreover, since the length of the chain cutter can be freely changed by adding or removing the pieces of the flaps 1, the workpiece to be cut is not restricted in size or dimension, and cutting is made in such a way that the chain cutter C is wound about the workpiece W. Thus, the workpiece W is not limited in configuration, and it is possible to efficiently cut a structure, for example a building, entirely including iron reinforcing rods within the building.

Further, since the individual flaps 1 are small in size and the same in configuration with each other so that mass-production enables the cost of the flaps 1 to be reduced, it is possible to reduce the manufacturing cost of the chain cutter C as a whole.

Furthermore, since the advancing direction of the cutting device is restricted by the flaps 1, the degree of flatness and the surface roughness of the cut surface are superior, and uneven wear does not occur in the cutting device. Thus, the performance efficiency of the cutting device is high.

Moreover, since the chain cutter C is in the form of a chain and is relatively light in weight, handling such as transportation or the like is easy. Further, since vibration occurring due to cutting is attenuated at the connecting sections between each pair of adjacent flaps, noises can also be reduced as compared with other cutting tools.

Furthermore, the invented chain cutter cuts primarily with the internal radius section of the chain, in which the spacing between the abrasive bits 30 is small and the bit density high, it is possible to perform cutting efficiently.

Moreover, since the cutting surface of the abrasive bit 30 is always tangent t the radius of curvature of the chain body 2, the longitudinal central section of the abrasive bit 30 is abutted against the workpiece W. Thus, the problems, such as catching of the leading edge of the abrasive bit 30 by the workpiece W to cause impeding of the rotation of the chain cutter C or breaking of the bit 30, do not occur.

Further, the engaging projection 40 and the engaging groove 38 of the flap 1 are in mesh with each other at the inwardly curved section, and the flaps 1 are firmly connected to each other. Accordingly, there do not occur problems such as the variation in the cutting widths and wondering of abrasive bits 30 due to vibrations of the individual flaps 1. Thus, it is possible to considerably raise the degree of flatness and the surface roughness of the cut surface as compared with a wire saw or the like. Furthermore, since the inner side surface of the flap 1 is abutted against the workpiece W at the inwardly bent section, the slit 22 will not open accidentally, so that there is no danger of the cutting device 4 to fall down from the recess 18.

In connection with the above, the above-described embodiment is such that the workpiece is cut horizontally. However, it is possible to apply the inner-peripheral-blade type chain cutter C to cutting in the vertical direction or in an oblique direction. Further, if saw tooth cutting segment is fixedly mounted to the flap 1 in place of the cutting device 4, it is possible to also cut large wood or the like.

Furthermore, in the above-described embodiment, the drive throughbore 6 is formed at a location within the connecting projection 8. In its place, the arrangement may be such that a recess is formed at the outer peripheral end of the flap 1, and the outer-peripheral side of the chain cutter extending between is wound about the sprockets, each having a plurality of drive pins on the outer peripheral surface thereof, and the recesses and the pins are in mesh with each other, to rotate the sprockets, thereby driving the chain.

Figure 18:
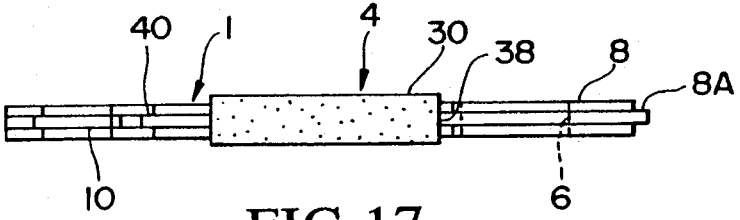
FIG. 18 is a top plan view of the flap illustrated in FIG. 17.
Figure 17:
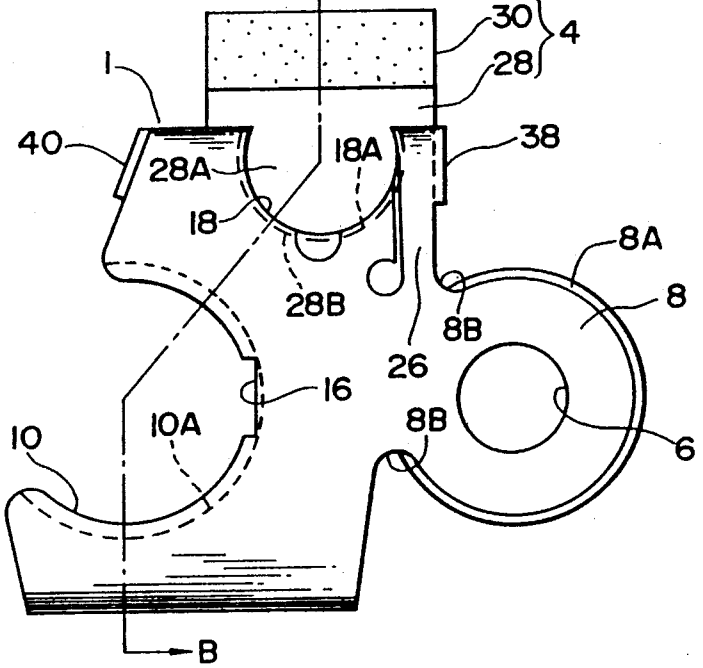
FIG. 17 is a front view of one of a plurality of flaps which are used in a second embodiment.
Figure 19:
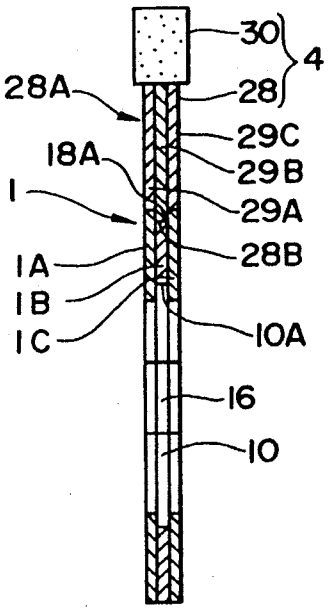
FIG. 19 is a cross-sectional view taken along the line B—B in FIG. 17.

FIGS. 17 through 19 are used next to describe another embodiment of the invention. Each of a plurality of flaps 1 according to the embodiment is formed such that three metal plates IA, IB and IC are stuck together. The metal plates IA and IC on both sides are equal in configuration to each other, while only the central metal plate IB is different in configuration from the other metal plates IA and IC. By so doing, a tapered surface 8A is formed on the outer peripheral surface of the connecting projection 8, while a groove 1OA is formed in the inner peripheral surface of the connecting cut-out 10. Likewise, formed in the embodiment are the engaging projection 40, the engaging groove 38, and the groove 18A in the inner peripheral surface of the mounting recess 18.

Further, the chip support 28 of the cutting device 4 is also formed such that three metal plates 29A, 29B and 29C are bonded together A projection 28B is formed on the outer peripheral surface of a mounting projection 28A.

Connecting of the flaps 1 to each other is conducted as follows. That is, all the flaps 1 are connected together without the metal plate 1A (or 1C), and subsequently, the metal plates 1A, 1B and 1C are fixedly mounted to each other by means of spot welding or the like.

According to the embodiment, it is possible to secure a large engaging thickness in each of the connecting projection 8 and the connecting cut-out 10 and it is possible to improve the connecting strength of the flaps 1.

Figure 20:
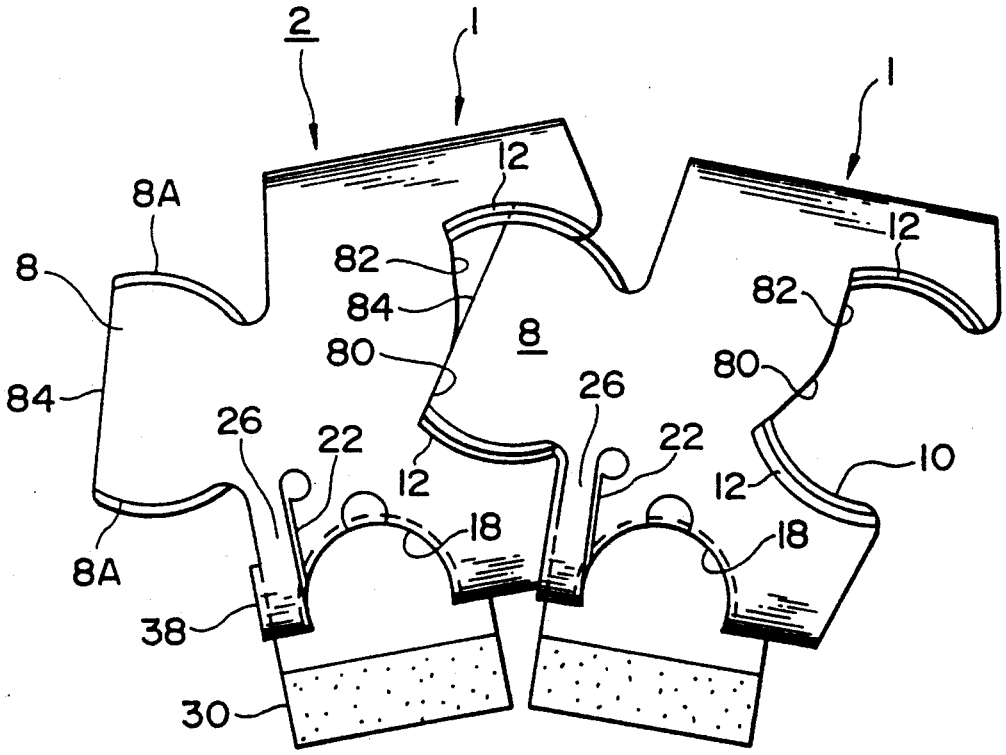
FIG. 20 is a front view showing parts of a third embodiment of the invention.

Next, FIG. 20 shows still another embodiment of the invention. The embodiment is characterized in that the connecting projection 8 is formed into a semi-circular configuration, and the connecting cut-out 10 is also formed into the same configuration as that of the connecting projection 8. Further, under the maximum inwardly curved condition, an end face 80 of the connecting cut-out 10 is abutted against an end face 84 of the connecting projection 8, while, under the maximum outwardly curved condition, an end face 82 of the connecting cut-out 10 is abutted against the end face 84 of the connecting projection 8.

According to the embodiment, there is produced an advantage that the flap 1 is made lighter in weight than the aforementioned embodiment.

In connection with the above, the invention should not be limited to the above-described embodiments Dimension or size, configuration and constitution may be modified or changed as occasion demands.

Figures 21, 22:
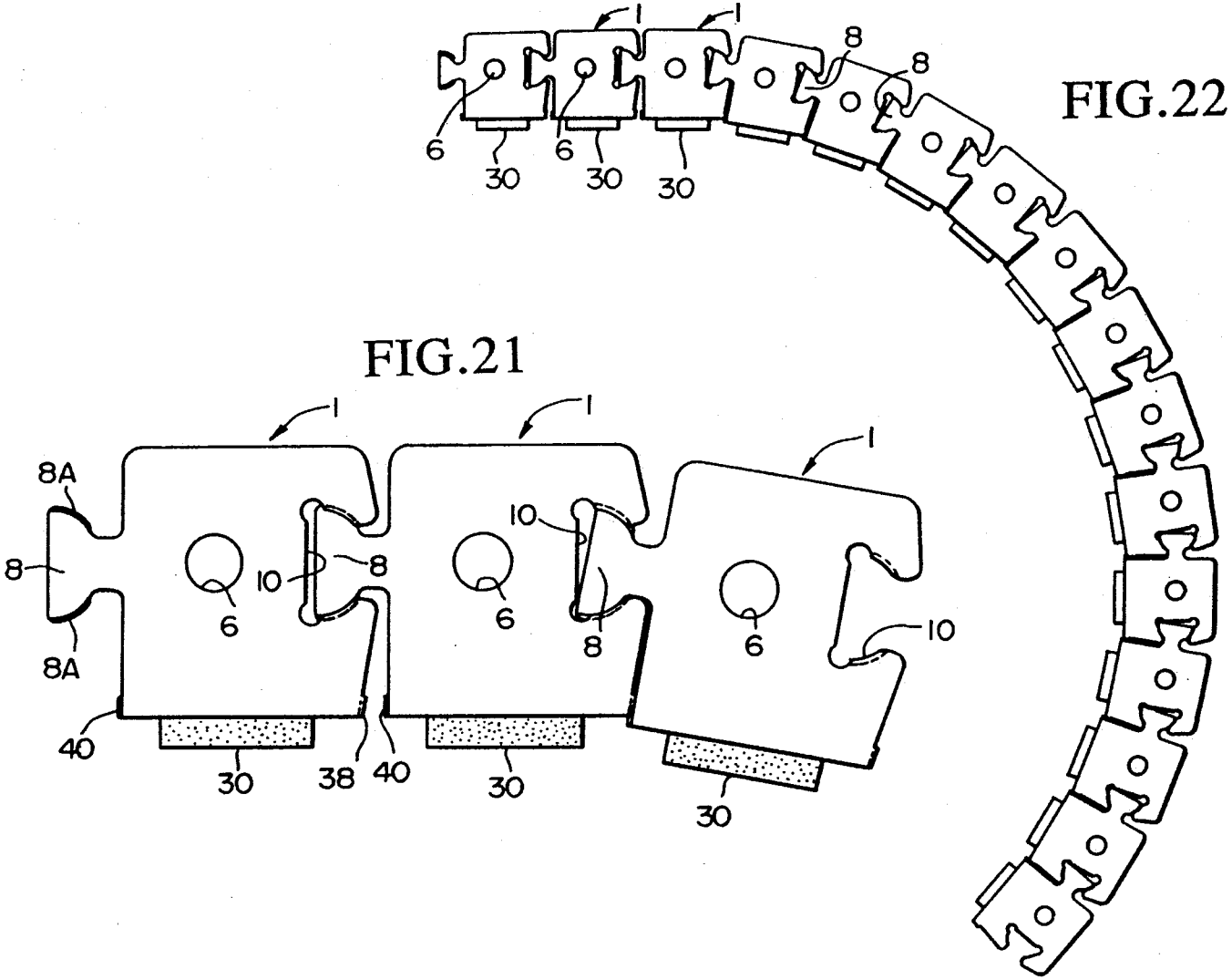
FIGS. 21 to 22 are front views of parts of a fourth embodiment.
Figure 24:
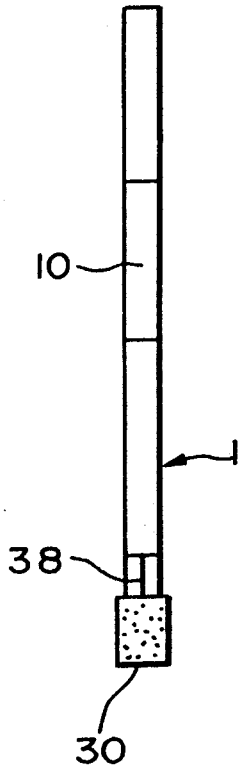
FIGS. 23 and 24 are a top view and a right side view of the flaps used in a fourth embodiment.

FIGS. 21 to 24 show a fourth embodiment of the chain cutter. As shown in FIG. 21, the dimension of the cut-out 10 is larger than that of the corresponding connecting projection 8 so as to permit the rotation of the projection 8 within the cut-out.

The projection 8 has additional protrusions 8A on the peripheral arc sections of the projection 8, and the cut-out 10 has corresponding channels 1OA on the interior peripheral sections of the cut-out.

Figure 23:
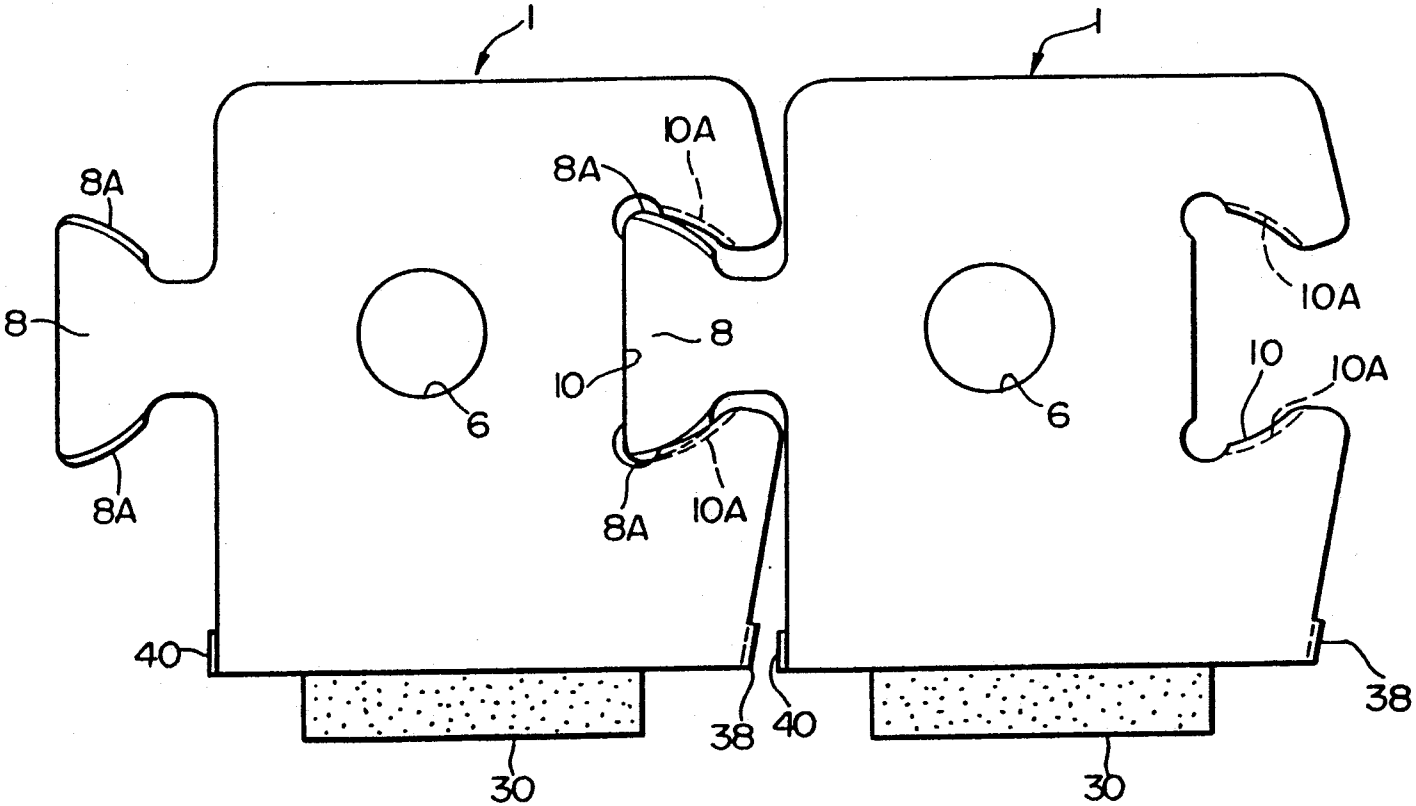

According to the embodiment, the connections are securely joined with each other under tension, but if the tension is removed, the flap can be compressed towards each other, thus altering the relative engaging of the projection and the cut-out, as shown in FIG. 23, and the flap can be disengaged by a simple twisting action.

Further, in the above embodiment, the abrasive bits 30 are rigidly bonded to each of the inside edge of the flap 1, and the manufacturing cost is correspondingly low. Further, in the center of each flap 1, there is a throughbore 6.

Figure 25:
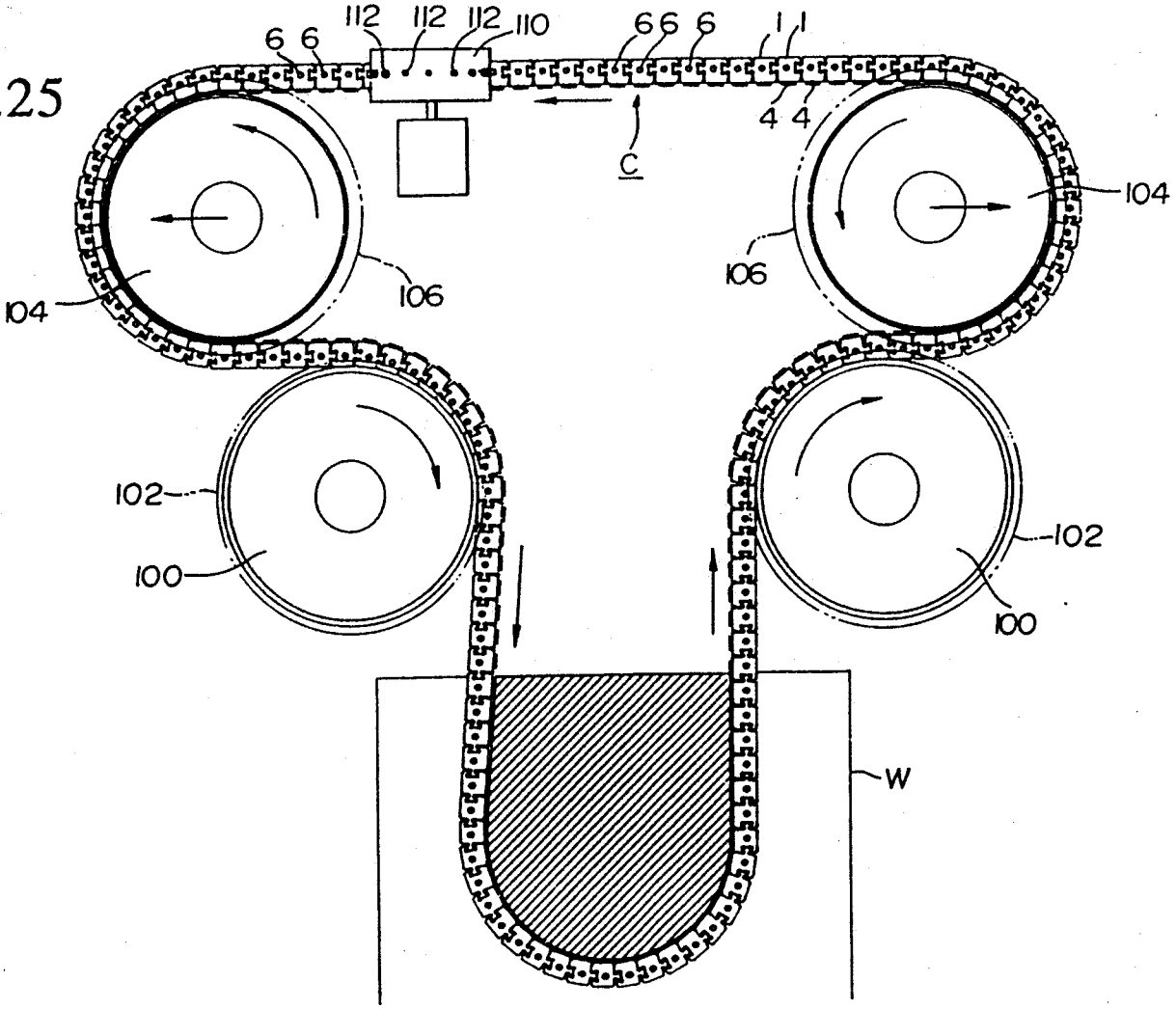
FIG. 25 is an example of a cutting apparatus used in a fourth embodiment.

FIG. 25 shows an embodiment as a cutting apparatus, in which a method of using the above chain cutter C is illustrated.

The chain cutter C is wound about a pair of fixed rotatable sprockets 100, a pair of rotatable and movable sprockets 104 and a workpiece W. This plane can be either vertical or horizontal. Each of the pairs of sprockets is provided with corresponding pair of support shafts 102 for sprocket 100 and support shafts 106 for sprockets 104.

On the linear side section of the chain cutter, there is installed a driving sprocket 110, and on the exterior surfaces of the driving sprockets are a plurality of driving pins 112 spaced equally and at regular intervals to fit into the through bores 6 of the chain cutter and to provide driving action to the chain cutter.

The chain cutter maintains the required tension in the chain by the action (not shown) of the separating moving sprockets 104 as the chain cutter moves into the workpiece is cut.

It is permissible to move just one of the two sprocket pairs 104, as well as just to move sprocket 100 to apply tension to the chain cutter.

FIGS. 26 to 29 show a fifth preferred embodiment in which the chain links can be removed easily by disconnecting of the flaps 1.

At one end of the flap 1 is a connecting projection 8 as was the case in the first embodiment, but the thickness of the connecting projection is less than that of the flap in this embodiment, and at the base of the connecting projection 8 is formed an arc-shaped step 200. On the opposite surface of the connecting projection 8 is formed a step 202 all around the complete periphery of a circle.

On the other hand, on the inside periphery of the opposite connecting cut-out 10, there is formed a corresponding connecting step 204 to fit with said step 202 on the connecting projection 8. By engaging the connecting projection 8 into the connecting cut-out 10 respective steps 202 is fitted into 204 are joined firmly to prevent disengagement of the connecting projection 8 from the reverse side.

Figure 26:
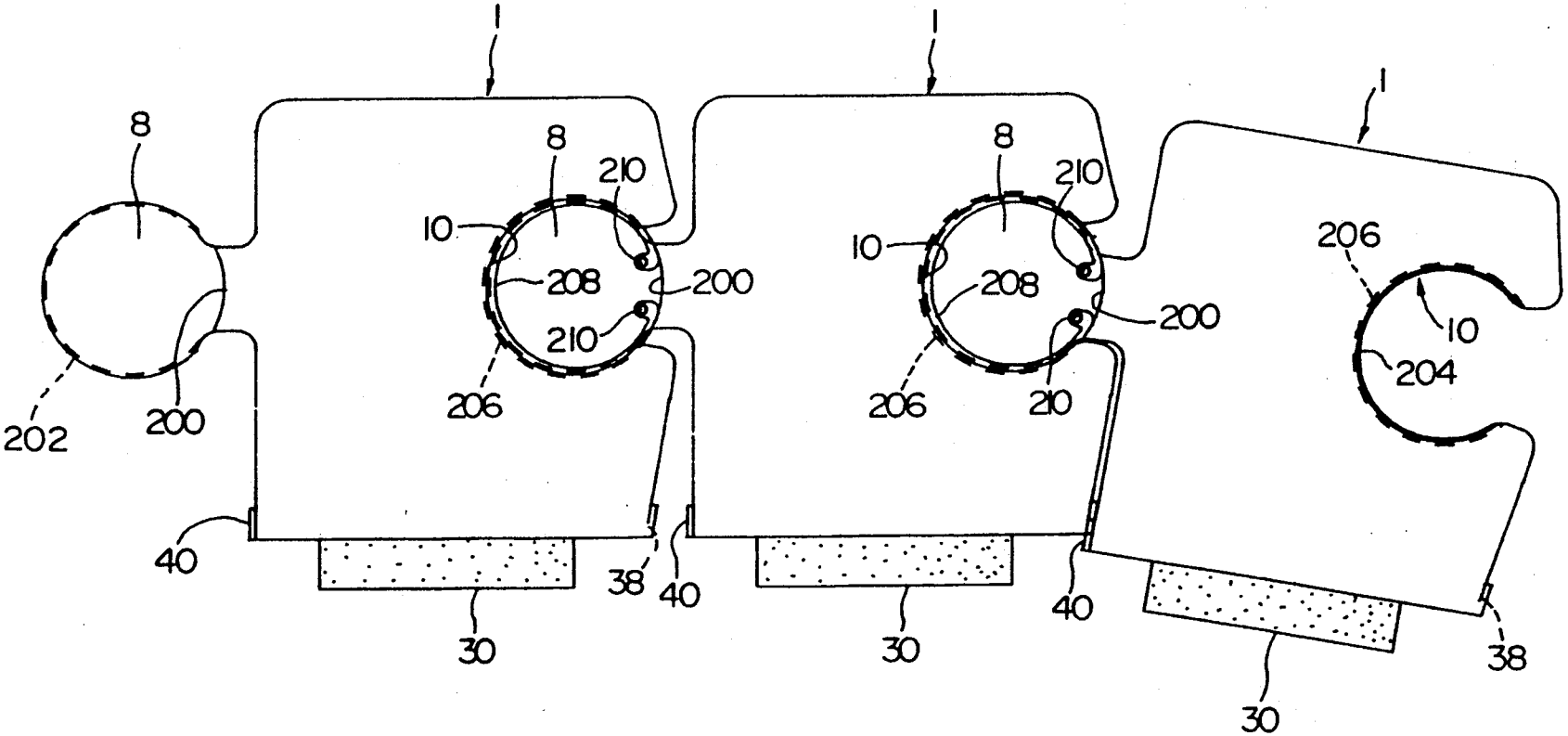
FIG. 26 is a front view of parts of the chain cutter in a fifth embodiment.
Figures 27, 28, 29:
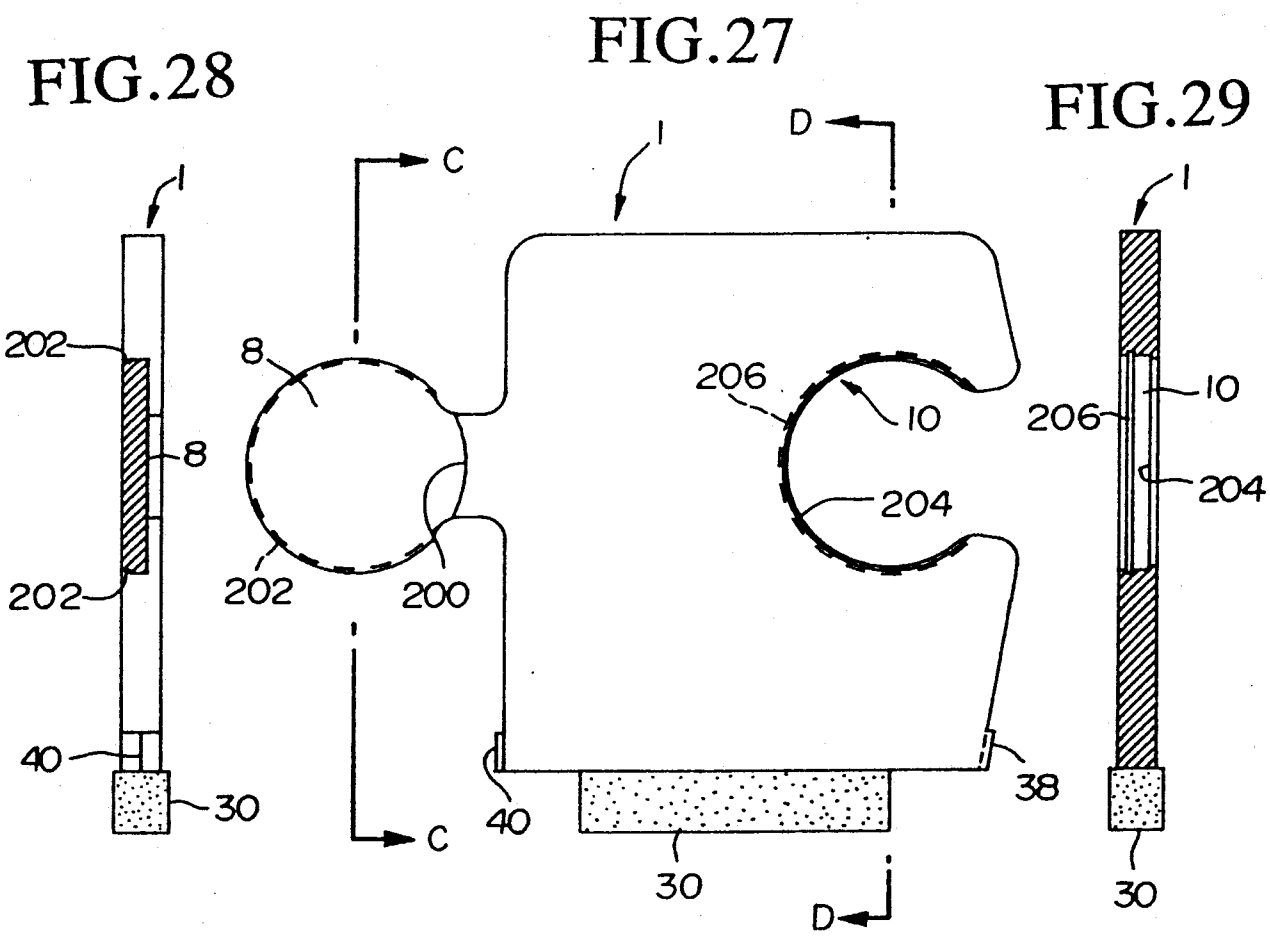
FIG. 27 is a front view of the flap used in the fifth embodiment.
FIG. 28 is a cross-sectional view taken along the line C—C in FIG. 27.
FIG. 29 is a cross-sectional view taken along the line D—D in FIG. 27.

On the inside peripheral surface of the connecting cut-out 10, is formed a ring groove 206 for a C-ring 208. As shown in FIG. 26, after fitting the connecting projection 8 into the connecting cut-out 10, a C-ring 208 is placed in the ring groove 206 to secure the said two connecting components t permit rotation of the components but not the movement in the direction of the thickness.

The reference numeral 210 refers to the holes provided at both ends of the C-ring 208, and are used for inserting the tips of the removal tool for removing the C-ring from the groove 206.

By utilizing such connections, it is easy to remove worn flaps 1 or to change the length of the chain cutter C by inserting or removing suitable number of flaps.

It is possible also to utilize limited number of such connections by having a fixed unit length of other type of connections described previously and employ the C-ring connection to join such unit lengths to produced the required length of chain cutter.

It is also possible to utilize snap rings in place of C-rings 208.

What is claimed is:

1. A chain cutter comprising:

a flexible, endless chain body having inner and outer sides and including a plurality of generally planar flaps connected to each other for angular movement in a common plane, each of said flaps having an end face on the inner side of the chain body, the chain body further including a plurality of cutting devices connected to the end faces of at least selected ones of the flaps, wherein each of the flaps has first and second opposite ends, the first end of each flap forms a connecting portion having a disc shape, the second end of each flap forms a connecting recess having a shape complementary with the shape of the connecting portion of the flap, and the connecting portion of each flap fits in the connecting recess of an adjacent flap to connect said each flap thereto, wherein the connecting portions and the connecting recesses connect the plurality of flaps to each other for angular movement in said common plane while inhibiting movement in a direction perpendicular to said common plane, and wherein the connecting portion of each flap has a central section forming a driving throughbore.

2. A chain cutter comprising:

a flexible, endless chain body having inner and outer sides and including a plurality of generally planar flaps connected to each other for angular movement in a common plane, each of the flaps having an end face on the inner side of the chain body;

the chain body further including a plurality of cutting devices, each of the cutting devices being releasably connected to the end faces of selected ones of the flaps;

each of the cutting devices including a mounting projection;

the end faces of each of the selected ones of the flaps forming a mounting recess receiving the mounting projection of the cutting devices connected to the flap; and each of the mounting recesses including an elastically movable section to selectively engage and release the mounting projection received in the mounting recess.

3. A chain cutter comprising:

a flexible, endless chain body having inner and outer edges, and including a plurality of generally planar flaps, each of the flaps having first and second opposite ends and a pair of side stop faces facing toward adjacent flaps;

the first end of each flap forming a first connecting portion having a first pair of peripheral surfaces having circular shapes, the second end of each flap forming a second connecting portion having a second pair of peripheral recesses having shapes matching the shapes of the first pair of peripheral surfaces of the flap, the first connecting portion of each one of the flaps being fitted into the second connecting portion of an adjacent flap, with the first pair of peripheral surfaces of said one flap abutted against the second pair of peripheral surfaces of said adjacent flap, to connect said one flap thereto, the first and second connecting portions of said plurality of flaps connecting the plurality of flaps to each other for angular movement in a common plane while preventing disengagement of the flaps from each other in a direction perpendicular to the common plane;

each of the flaps having an end face on the inner edge of the chain body, each of at lest selected ones of the plurality of the flaps having a cutting device located at the end face of the flap; and each flap having an area forming a driving throughhole, the driving throughhole of the flaps that are disposed in a longitudinal direction of the chain body being disposed at regular intervals;

wherein when the chain body bends inwardly to form an arc having a radius of curvature and the side stop faces of adjacent flaps in said arc abut against each other, the side stop faces of the adjacent flaps maintain the radius of curvature of said arc at a substantially fixed, predetermined minimum value.

4. The chain cutter according to claim 3, further including connecting means releasably mounted on and further connecting at least selected ones of the flaps to adjacent flaps.

5. The chain cutter according to claim 3, wherein each of said cutting devices is an abrasive bit.

6. The chain cutter according to claim 3, wherein each of said cutting devices is releasably mounted on a corresponding one of said flaps.

7. The chain cutter according to claim 3, wherein:

one of the side stop faces of each flap has a first engaging means, and other of the side stop faces has a second engaging means, and the first engaging means of each flap and the second engaging means of the adjacent flap engage with each other to prevent disengagement of the flaps in the direction perpendicular to the common plane when the chain body bends inwardly to form an arc having a radius of curvature at the predetermined minimum value.

8. A chain cutter comprising: a flexible endless chain body having inner and outer edges, and including a plurality of generally planar flaps, each of the flaps having first and second opposite ends and a pair of side stop faces facing toward adjacent flaps;

the first end of each flap forming a connecting protrusion having a disk shape, and the second end of each flap forming a connecting recess having a shape complementary with the shape of the connecting protrusion of the flap; the connecting protrusion of each flap being fitted into the connecting recess of an adjacent flap to connect said each flap thereto, the connecting protrusions and the connecting recesses of the flaps connecting the plurality of flaps together for angular movement in a common plane while inhibiting disengagement of the flaps from each other in a direction perpendicular to the common plane;

each of the flaps having an end face on the inner edge of the chain body, each of at least selected ones of the plurality of the flaps having a cutting device located at the end face of the flap; and each flap having an area forming a driving throughhole, the driving throughhole of the flaps that are disposed in a longitudinal direction of the chain body being disposes at regular intervals;

wherein when the chain body bends inwardly to form an arc having a radius of curvature and the side stop faces of adjacent flaps in said arc abut against each other, the side stop faces of the adjacent flaps maintain the radius of curvature of said arc at a substantially fixed, predetermined minimum value.

9. The chain cutter according to claim 8, wherein:

the connecting protrusion of each flap has a first engaging portion on an outer peripheral surface thereof, and the first engaging portion of each flap is elongated in a circumferential direction of the outer peripheral surface of the connecting protrusion of the flap;

the connecting recess of each flap has a second engaging portion on an inner peripheral surface thereof, and the second engaging portion of each flap is elongated in a circumferential direction of the inner peripheral surface of the connecting recess of the flap; and the first engaging portion of each flap fits with a corresponding second engaging portion of the adjacent flap to prevent disengagement of the flaps from each other in the direction perpendicular to the common plane.

10. A chain cutter comprising:

a flexible endless chain body having inner and outer edges, and including a plurality of generally planar flaps, each of the flaps having first and second opposite ends and a pair of side stop faces facing toward adjacent flaps;

the first end of each flap forming a connecting protrusion having a semi-circular shape having a first pair of peripheral surfaces, the second end of each flap forming a connecting recess having a second pair of peripheral surfaces having shape complementary with the shape of each of the first pair of peripheral surfaces of the connecting protrusion of the flap; and the connecting protrusion of each one of the flaps being fitted into the connecting recess of the adjacent flap with the first pair of peripheral surfaces of said one of the flaps abutting against the second pair of peripheral surfaces of the adjacent flap, the connecting protrusions and the connecting recesses connecting the plurality of flaps for angular movement in the common plane;

each of the flaps having an end face on the inner edge of the chain body, each of at least selected ones of the plurality of the flaps having a cutting device located at the end face of the flap;

wherein when the chain body bends inwardly to form an arc having a radius of curvature and the side stop faces of adjacent flaps in said arc abut against each other, the side stop faces of the adjacent flaps maintain the radius of curvature of said arc at a substantially fixed, predetermined minimum value.

11. The chain cutter according to claim 10, for use with a driving sprocket to drive the chain cutter, and wherein each of the flaps forms at least one engaging section for engaging the driving sprocket.

12. The chain cutter according to claim 10, wherein :

the first pair of peripheral surfaces of each flap have a pair of first engaging portions, the first engaging portions are elongated in a circumferential direction of the first pair of peripheral surfaces;

the second pair of peripheral surfaces of each flap having a pair of second engaging portions, the second engaging portions are elongated in a circumferential direction of the second pair of peripheral surfaces; and each of the first engaging portions of the connecting protrusion of each flap fits with a corresponding one of the second engaging portions of the connecting recess of the adjacent flap to prevent disengagement of the flaps from each other in a direction perpendicular to the common plane.

13. The chain cutter according to claim 12, wherein:

the connecting recess of the each flap has an enough depth to permit shortening of a connecting length of the adjacent pair of flaps, and the first engaging portions of each connecting protrusion disengage from the corresponding second engaging portions of the adjacent flap when the connecting length of the adjacent pair of the flaps is shortened, and the pair of the flaps becomes detachable from each other in the direction perpendicular to the common plane.

14. A chain cutter comprising:

a flexible endless chain body having inner and outer edges and including a plurality of generally planar flaps, each of the flaps having a center plate having two sides, and a pair of side plates bonded to the sides of the center plate;

each of the flaps having first and second opposite ends, the first end of the flap forming a connecting protrusion having at least a first engaging portion formed with the center plate on a peripheral surface thereof;

the second end of each flap forming a connecting recess having a shape complementary with the shape of the connecting protrusion of the flap, the connecting recess of each flap including at least a second engaging portion formed with the center plate on an inner peripheral surface thereof;

the connecting protrusion of each one of the flaps being fitted into the connecting recess of an adjacent flap with the first engaging portion of said one of the flaps engaged with the second engaging portion of said adjacent flap, the connecting protrusions and the connecting recesses of the plurality of flaps connecting the plurality of flaps together for an angular movement in a common plane while inhibiting disengagement of the flaps from each other in a direction perpendicular to the common plane;

each of the flaps having an end face on the inner edge of the chain body, each of at least selected ones of the plurality of the flaps having a cutting device located at the end face of the flap;

wherein the center plate and the side plates of each flap contact with the center plate and the side plates of the adjacent flap respectively, between the connecting protrusion and the connecting recess when a tensile force is applied to the chain body.

15. A chain cutter comprising:

a flexible endless chain body having inner and outer edges, and including a plurality of generally planar flaps, each of the flaps having first and second opposite ends;

the first end of each flap forming a connecting protrusion having a disk shape, the second end of each flap forming a connecting recess having a shape complementary with the shape of the connecting protrusion of the flap, and the connecting protrusion of each flap fitting in the connecting recess of an adjacent flap to connect said each flap thereto, the connecting protrusions and the connecting recesses of the plurality of flaps connecting the plurality of flaps together for angular movement in a common plane;

the connecting recess having a groove and an engaging protrusion on an inner peripheral surface thereof, the groove and the engaging protrusion extending parallel along the inner peripheral surface of the connecting recess, a fixing means mounted on the groove in a detachable manner, and the fixing means and the engaging protrusion holding the connecting protrusion therebetween to prevent disengagement of the flaps from each other in a direction perpendicular to the common plane;

each of the flaps having an end face on the inner edge of the chain body, each of at least selected ones of the plurality of the flaps having a cutting device located at the end face of the flap;

wherein the connecting protrusion of each flap becomes detachable from the connecting recess in the direction perpendicular to the common plane when the fixing means is detached from the groove of the connecting recess.

16. The chain cutter according to claim 15, wherein: the fixing means is an elastic C-shaped plate, an outer periphery of the plate is fitted in the groove of the connecting recess, and the plate becomes detachable from the groove when a diameter of the plate is reduced.

* * * * *

UNITED STATES PATENT AND TRADEMARK OFFICE

CERTIFICATE OF CORRECTION

PATENT NO. : 5,209,216

DATED : May 11, 1993

INVENTOR(S) : Katsumi Mogi

It is certified that error appears in the above-indentified patent and that said Letters Patent is hereby corrected as shown below:

Column 5, line 61: "o" should read --on--

Column 7, line 65: "o" should read --on--

Column 8, line 62: "said" should read --side--

Column 10, line 16: "t" should read --to--

Column 11, line 5: after "together" insert --.--

Column 11, line 34: after "embodiments" insert --.--

Column 11, line 57: "as" should read --of--

Column 12, line 36: "t" should read --to--

Column 12, line 47: "type" should read --types--

Column 13, line 56: "lest" should read --least--

UNITED STATES PATENT AND TRADEMARK OFFICE

CERTIFICATE OF CORRECTION

PATENT NO. : 5,209,216

DATED : May 11, 1993

INVENTOR(S) : Katsumi Mogi

It is certified that error appears in the above-indentified patent and that said Letters Patent is hereby corrected as shown below:

Column 14, line 46, "disposes" should read --disposed--

Signed and Sealed this

Fifth Day of July, 1994

*Attest:*

*Attesting Officer*

BRUCE LEHMAN

*Commissioner of Patents and Trademarks*